US008316686B2

(12) United States Patent
Summers

(10) Patent No.: US 8,316,686 B2
(45) Date of Patent: Nov. 27, 2012

(54) PRESS TOOL ARRANGEMENT

(75) Inventor: Timothy J. Summers, Nottingham (GB)

(73) Assignee: Rolls-Royce PLC, London (GB)

( * ) Notice: Subject to any disclaimer, the term of this patent is extended or adjusted under 35 U.S.C. 154(b) by 486 days.

(21) Appl. No.: 12/461,854

(22) Filed: Aug. 26, 2009

(65) Prior Publication Data

US 2010/0064758 A1 Mar. 18, 2010

(30) Foreign Application Priority Data

Sep. 17, 2008 (GB) ..... 0816949.2

(51) Int. Cl.
*B21J 9/18* (2006.01)
*B21D 24/02* (2006.01)

(52) U.S. Cl. ..... 72/466.9; 72/347; 72/455; 72/453.13

(58) Field of Classification Search ..... 72/344, 72/350, 351, 455, 456, 354.8, 453.13, 466.9
See application file for complete search history.

(56) References Cited

U.S. PATENT DOCUMENTS

| | | | | |
|---|---|---|---|---|
| 3,739,617 | A | 6/1973 | Stejskal | |
| 4,188,811 | A | 2/1980 | Brimm | |
| 4,703,644 | A * | 11/1987 | Waldner | 72/430 |
| 4,732,033 | A * | 3/1988 | Smedberg et al. | 72/453.13 |
| 5,345,799 | A | 9/1994 | Miodushevski et al. | |
| 6,742,377 | B2 * | 6/2004 | Woods et al. | 72/412 |
| 7,004,007 | B2 * | 2/2006 | Kruger et al. | 72/453.13 |
| 7,213,434 | B2 * | 5/2007 | Sato | 72/354.8 |

* cited by examiner

*Primary Examiner* — David B Jones
(74) *Attorney, Agent, or Firm* — Oliff & Berridge, PLC

(57) ABSTRACT

A press tool arrangement for use in hot creep forming, a method of hot creep forming a component of titanium alloy, and a resilient urging arrangement usable at elevated temperatures are described. The press tool arrangement includes a die, a holder member engageable with a blank of material in the die, and a resilient urging arrangement engageable with the holder member to urge same against a blank of material in the die.

10 Claims, 2 Drawing Sheets

PRESS TOOL ARRANGEMENT

This invention concerns a press tool arrangement for use in hot creep forming, a method of hot creep forming a component of titanium alloy, and a resilient urging arrangement usable at elevated temperatures.

In hot creep forming (HCF) a component of a high strength alloy material and usually a titanium alloy, is formed at high temperatures in excess of 650° C. at a controlled creep speed of generally around 2 $mms^{-1}$.

Conventionally the HCF process uses just a punch and a die. This means that the process is solely reliant on the form of the shape of the component being formed not being too extreme, and any wrinkling tendency of the process must be removed by the elevated temperatures and the force of the press. This can be quite effective on slightly wrinkled areas, but requires that both the punch and the die are very accurately "bedded" (mated together) which requires a significant amount of hand finishing of the form in a spotting press.

Recently additional methods have been developed to control the flow of material into the die. One such method is to use forming pins which are located in the surrounding tool geometry to keep the blank taught throughout the forming cycle. The forming pins can be very effective for controlling the flow of material. However, after forming when the component is ready for removal from the tool, it will need to be prized from the pins, which usually requires a trim down of the component and restrike in order to achieve drawing requirements.

Another option is to incorporate a cushion onto the press and to use a blank holder in the tool so that the material can be controlled by a force to stop it wrinkling as it flows into the die cavity. This requires a double action press which is not common in the HCF industry. Therefore this technique can only be used on a limited number of existing HCF presses.

If the form of the component to be pressed is deemed too extreme to be manufactured by HCF, "superplastic forming" can be used. In this process a material is trapped under load via the press and blown using an inert gas such as argon into the die cavity. With this process it is possible to achieve very complex forms without wrinkling. However, using this process generally achieves a variable material thickness distribution in that it is inherent in the process that the material thins, and so a much thicker starting stock is usually required to achieve a component of a required minimum thickness.

This process is also carried out at higher temperatures than HCF, and generally at temperatures in excess of 850° C., with considerably longer cycle times. These features lead to additional cost in forming a component, and also increases the amount of Alpha case build up on the component's surface which will require chemical removal.

According to a first aspect of the invention there is provided a press tool arrangement for use in hot creep forming, the arrangement including a die, a holder member engageable with a blank of material in the die, and a resilient urging arrangement engageable with the holder member to urge same against a blank of material in the die. The resilient urging arrangement may include a resilient member located in a thermally insulating cover.

The thermally insulating cover may be made of ceramics material.

The thermally insulating cover may include a pair of members mounted together in a telescopic arrangement so as to cover the resilient member in different degrees of extension or compression thereof.

A cooling system may be provided for passing a cooling fluid through the interior of the resilient urging arrangement cover, which fluid may be air.

A fluid inlet may be provided at or adjacent one end of the cover, with a fluid outlet at or adjacent an opposite end of the cover.

The resilient member may be a spring. The spring may be made of steel. Alternatively the spring may be made of an alloy such as nickel-chromium, and may be Nimonic 90™ (available from the Special Metals Group of Companies).

A plurality of resilient urging arrangements may be provided engageable against the holder member.

According to a second aspect of the invention there is provided a method of hot creep forming a component of titanium alloy, the method including using a press tool arrangement according to any of the preceding eight paragraphs.

A resilient member or members of a required strength can be chosen dependent on the degree of resilient urging required.

The cooling fluid may be chilled prior to passing through the cover.

An embodiment of the present invention will now be described by way of example only and with reference to the accompanying drawings, in which:—

Figure 1:
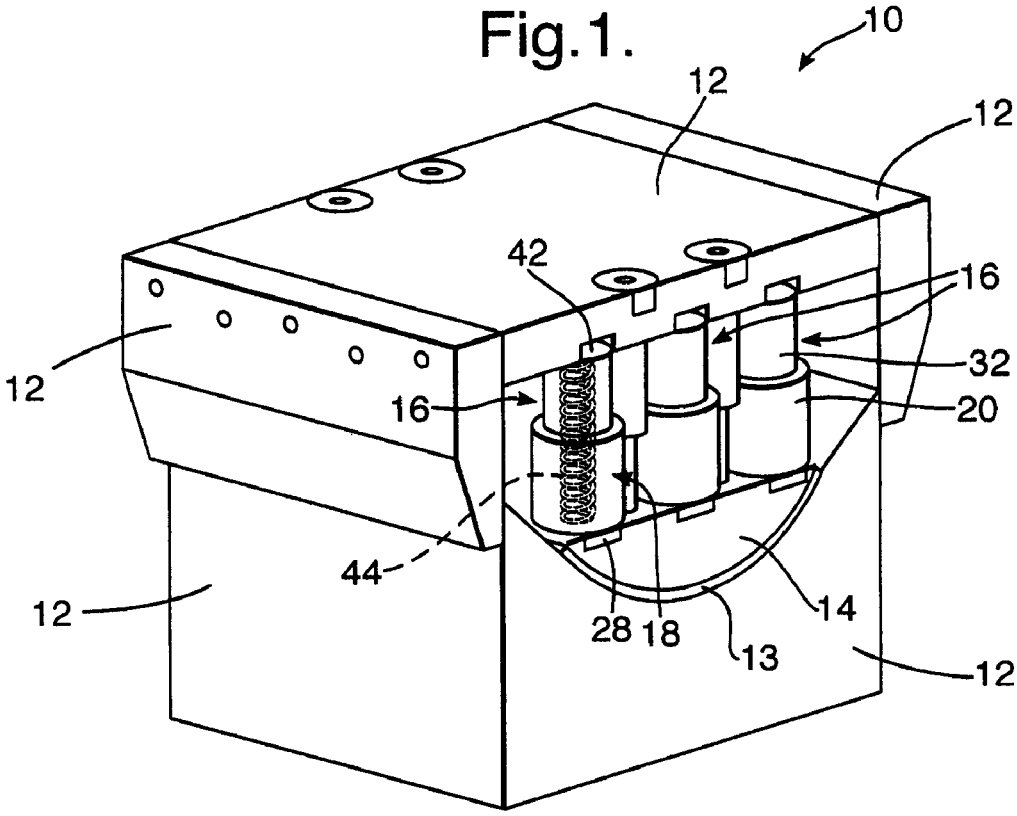
FIG. 1 is a diagrammatic perspective view of a press tool arrangement according to the invention.
Figure 2:
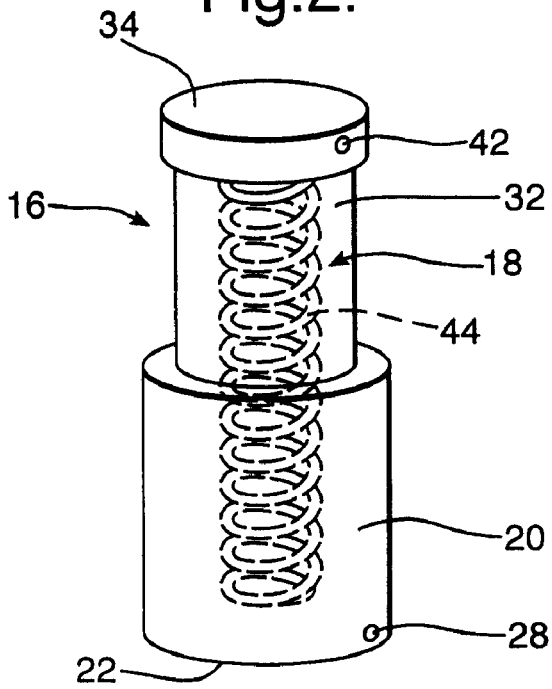
FIG. 2 is a diagrammatic perspective view of a part of the arrangement of FIG. 1.
Figure 3:
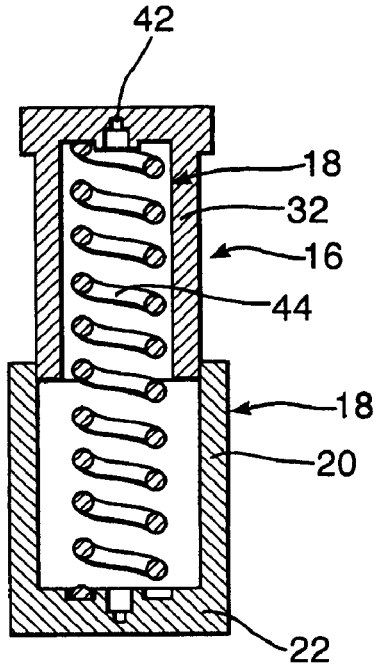
FIG. 3 is a diagrammatic cross sectional view through the part of FIG. 2.

The drawings show a press tool arrangement 10 with die 12 and a holder member in the form of a pressure pad 14. Three resilient urging arrangements 16 engage against the top surface of the pressure pad 14 to urge same against the die 12 and hence a blank of material 13 located thereon during forming of a component.

Each urging arrangement 16 comprises a ceramic casing 18 with a lower part 20 which is in the form of a hollow cylinder which is open at its upper end and is closed off by a base 22. The base 22 has a slightly raised central section 24 through which a passage 26 extends. The passage 26 connects with a radial inlet 28. An annular groove 30 surrounds the central section 24.

Figure 4:
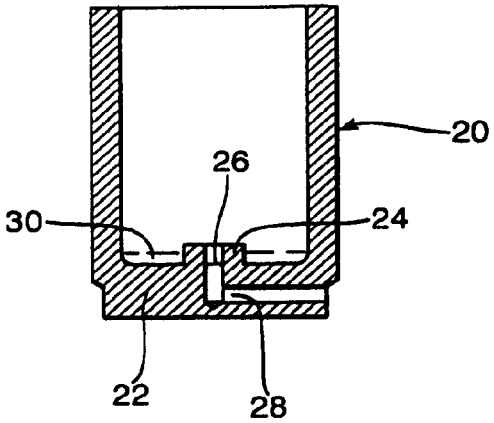
FIGS. 4 and 5 are diagrammatic cross sectional views through respective components of the part of FIG. 2.
Figure 5:
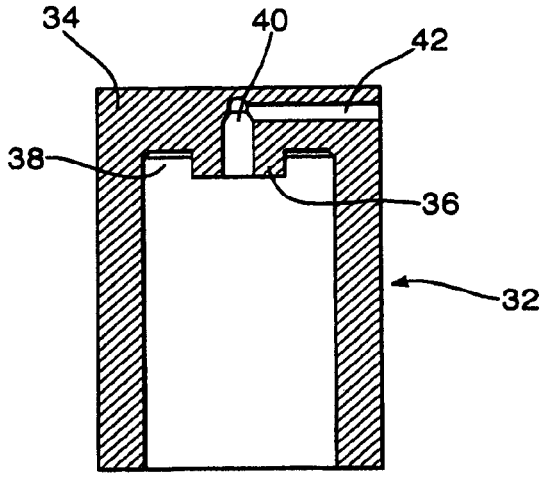
Figure 6:
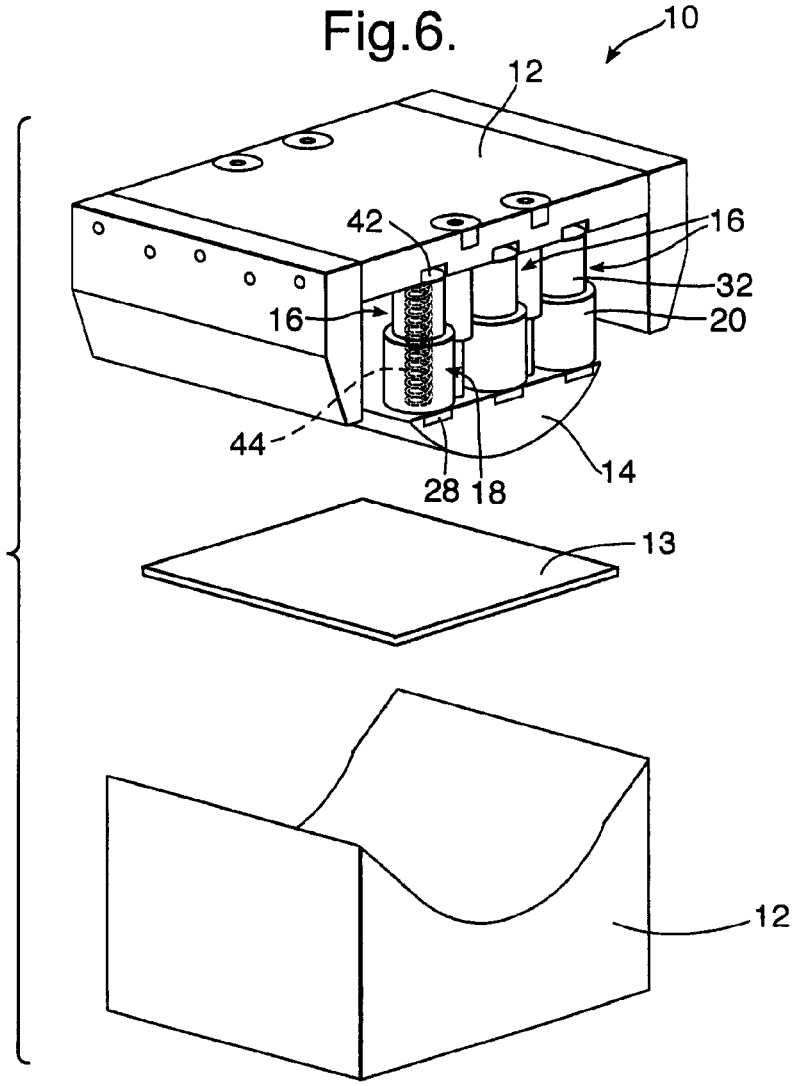
FIG. 6 is a diagrammatic perspective view of the press tool arrangement of FIG. 1, shown in an open position.

The casing 18 also includes an upper part 32. The upper part 32 is generally similar to the lower part 20 but in use will have its base 34 uppermost. The upper part 32 is of a smaller diameter than the lower part so as to be telescopically locatable therein, and slidably movable relative thereto. The lower and upper parts 20, 32 are not shown to scale in FIGS. 4 and 5. The base 34 again includes a central section 36 surrounded by an annular groove 38. A passage 40 extends into the central section of the passage, and the passage 40 connects with a radial outlet 42.

A compression spring 44 locates within the casing 18, with ends of the spring 44 engaging respectively in the grooves 30 and 38. The spring 44 may be made of steel with a working temperature of up to 250° C. Alternatively the spring may be made of a nickel-chromium alloy such as Nimonic 90™ (available from Special Metals Group of Companies), which has a working temperature of up to 650° C.

In use springs 44 of a required strength are chosen dependent on the component to be formed. The arrangement is heated and titanium is introduced into the die and creeps thereover. A controlling force is applied to the blank of titanium by the pressure pad 14 being urged thereagainst by the urging arrangements 16. As more titanium creeps onto the die, the springs 44 will be compressed, with the upper part 32 of the casing 18 telescopically sliding into the lower part 20.

Air is blown through the inlet 28 into the casing 18, and exits through the outlet 42 to be removed into the atmosphere. The cooling air is supplied to the inlets 28 by a manifold (not shown). The air cools the interior of the casing, maintaining the springs 44 at a temperature at which they operate efficiently. The ceramic material of the casing prevents any radiant heat from directly playing onto the springs.

With using the arrangement 10 it has been found that less material thinning takes place and the material flows into the die 12 instead of being restrained and stretched. The air cooling within the casings 18 permits the springs 44 to retain their operational efficiency.

This arrangement provides a relatively low cost improvement to a conventional HCF process, and arrangements according to the invention can be retrofitted to existing tooling which previously may have proved troublesome. Springs of a required type and performance can be chosen and readily swapped in the casings 18 as conditions dictate. The arrangements can be. transferred between different presses as required.

Various modifications may be made without departing from the scope of the invention. For example, the casings may take a different form, and thicker casings can be used if required, and particularly to protect steel springs. The air could be chilled prior to supplying into the casings.

The ends of the springs tend to be subjected to more heat than the centre. To overcome this, the ends of the casing could be thicker, and/or an air gallery could be provided at the ends of the casing to cause the cooling air to circulate around the ends instead of passing straight through the casing.

Whilst the above described apparatus and method relates to hot creep forming, it is to be realized that the resilient urging arrangements could be used in a range of processes where it is required to apply a load to a product at elevated temperatures.

The invention claimed is :

1. A press tool arrangement for use in hot creep forming of a blank of material, the arrangement comprising:

a die in which the blank of material is disposed;

a holder member engageable with the blank of material in the die; and a resilient urging arrangement engageable with the holder member to urge the holder member against the blank of material in the die, wherein the resilient urging arrangement includes a resilient member located in a thermally insulating cover.

2. An arrangement according to claim 1, wherein the thermally insulating cover is made of ceramics material.

3. An arrangement according to claim 2, wherein the thermally insulating cover includes a pair of members mounted together in a telescopic arrangement so as to cover the resilient member in different degrees of extension or compression thereof.

4. An arrangement according to any of claim 1, wherein a cooling system is provided for passing a cooling fluid through the interior of the resilient urging arrangement cover.

5. An arrangement according to claim 4, wherein the cooling fluid is air.

6. An arrangement according to claims 4, wherein a fluid inlet is provided at or adjacent one end of the cover, with a fluid outlet at or adjacent an opposite end of the cover.

7. An arrangement according to claim 1, wherein the resilient member is a spring.

8. An arrangement according to claim 7, wherein the spring is made of steel.

9. An arrangement according to claim 8, wherein the spring is made of an alloy such as nickel-chromium.

10. An arrangement according to claim 1, wherein a plurality of resilient urging arrangements are provided engageable against the holder member.

* * * * *